US006413709B1

(12) United States Patent
Takeda

(10) Patent No.: US 6,413,709 B1
(45) Date of Patent: Jul. 2, 2002

(54) SILVER HALIDE PHOTOGRAPHIC MATERIAL

(75) Inventor: Naohiro Takeda, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/665,520

(22) Filed: Sep. 19, 2000

(30) Foreign Application Priority Data

Sep. 29, 1999 (JP) ..... 11-277007

(51) Int. Cl.[7] ..... G03C 1/005; G03C 1/495
(52) U.S. Cl. ..... 430/567; 430/569
(58) Field of Search ..... 430/567, 569

(56) References Cited

U.S. PATENT DOCUMENTS 5,707,793 A * 1/1998 Oyamada ..... 430/567

6,083,678 A * 7/2000 Verrept et al. ..... 430/569

* cited by examiner

*Primary Examiner*—Geraldine Letscher
(74) *Attorney, Agent, or Firm*—Sughrue Mion, PLLC

(57) ABSTRACT

A silver halide photographic material using a high-sensitivity sensitive silver halide photographic emulsion having high sensitivity in inherent absorption of silver halide grains thereof, having small inherent desensitization also in addition of a sensitizing dye and also improved in spectral sensitivity, which comprises a support having provided thereon at least one layer of a light-sensitive silver halide emulsion, in which the emulsion comprises at least a dispersing medium and silver halide grains, and 50% or more of the total projected area of the silver halide grains is occupied by grains each having therein at least one twin plane and at least one dislocation line not parallel to the twin plane.

7 Claims, 1 Drawing Sheet

SILVER HALIDE PHOTOGRAPHIC MATERIAL

FIELD OF THE INVENTION

The present invention relates to a silver halide photographic material, and more particularly to a silver halide photographic material using a high-sensitivity sensitive silver halide photographic emulsion having high sensitivity in inherent absorption of the silver halide grains thereof, having small inherent desensitization also in addition of a sensitizing dye and also improved in spectral sensitivity.

BACKGROUND OF THE INVENTION

When tabular silver halide grains are used in photographic materials, they are improved in spectral sensitization, sharpness, light scattering characteristics, covering power, development progress and granularity, compared with non-tabular silver halide grains. Accordingly, tabular grains having twin planes parallel to each other and having {111} faces as major faces have come to be variously used. For details thereof, reference can be made to the descriptions of JP-A-58-113926 (the term "JP-A" as used herein means an "unexamined published Japanese patent application"), JP-A-58-113927, JP-A-58-113928, JP-A-2-828, JP-A-2-28638 and JP-A-2-298935. When sensitizing dyes are adsorbed in large amounts by silver halide grains, grains having {100} faces are usually better in color sensitivity characteristics. Recently, therefore, tabular silver halide grains having {100} faces as major faces have been developed. For details thereof, reference can be made to the description of JP-A-51-88017, JP-B-64-8323 (the term "JP-B" as used herein means an "examined Japanese patent publication"), JP-A-5-281640, JP-A-5-313273, JP-A-6-59360, JP-A-6-324446, JP-A-8-122954, JP-A-9-34045, JP-A-9-189977, EP-A-0534395, and U.S. Pat. Nos. 5,292,632, 5,314,798 and 5,264,337. However, tabular silver halide grains are known to deteriorate in pressure properties (pressure-induced fog and pressure-induced desensitization) Further, JP-A-6-43605 and JP-A-6-43606 disclose that when tabular grains high in aspect ratio are decreased to less than 0.1 $\mu$m in thickness, light reflection characteristics thereof rapidly deteriorate.

Non-tabular grains having a thickness exceeding 0.3 $\mu$m also find photographic applications in which advantages accrue because of their thickness. For example, it is proposed that they are used in a technique for complementing a light (for example, a blue light) in a spectral region in which a silver halide exhibits inherent sensitivity at its maximum. Examples thereof include a complement of an insufficient blue light of an artificial light source such as a tungsten filament lamp.

On the other hand, the influence of dislocation on photographic characteristics is described in G. C. Farnell, R. B. Flint and J. B. Chanter, *J. Phot. Sci.*, 13, 25 (1965), which indicates that in tabular AgBr grains large in size and high in aspect ratio, places where latent image nuclei are formed and defects in the grains are in a close relation.

Techniques for introducing dislocation into normal crystal silver halide grains are described in JP-A-4-263246, JP-A-4-317050 and JP-A-4-348337. The dislocation-introduced normal crystal grains provide photographic materials high in sensitivity, excellent in granularity and sharpness, and moreover improved in pressure properties.

Techniques for utilizing dislocation (screw dislocation) for giving anisotropic growth to normal crystal grains are disclosed in JP-A-6-59360, JP-A-7-234470, JP-A-8-122954, JP-A-8-339044, JP-A-9-189977 and Japanese Patent Application No. 11-92883. In Japanese Patent Application No. 11-92883, it is described that in such a case, the number of dislocation lines is as small as 10 or less, but the photographic characteristics are sufficiently improved (the spectral sensitivity is increased, and the inherent desensitization is also reduced in addition of a sensitizing dye).

JP-A-63-220238, JP-A-1-201649, JP-A-2-127635, JP-A-3-237450, JP-A-4-191729 and JP-A-4-195035 disclose techniques for introducing dislocation into tabular silver halide grains having twin planes parallel to each other and having {111} faces as major faces. It is shown that the dislocation-introduced tabular grains are excellent in photographic characteristics such as sensitivity and reciprocity law, compared with grains having no dislocation, and that the use thereof in photographic materials results in excellent sharpness and granularity. As to sites where dislocation lines exist, peripheries, major faces, vertex portions or combinations thereof are described. However, grains in which dislocation lines are geometrically specified to twin planes have never known. Further, the number of dislocation lines is not less than 10, and no example has been known in which less than 10 dislocation lines improve the photographic characteristics.

SUMMARY OF THE INVENTION

It is therefore an object of the invention to provide a silver halide photographic material using a high-sensitivity sensitive silver halide photographic emulsion having high sensitivity in inherent absorption of silver halide grains thereof, having small inherent desensitization also in addition of a sensitizing dye and also improved in spectral sensitivity.

The object of the invention has been attained by the following silver halide photographic materials (1) A silver halide photographic material comprising a support having provided thereon at least one layer of a light-sensitive silver halide emulsion, in which the emulsion comprises at least a dispersing medium and silver halide grains, and 50% or more of the total projected area of the silver halide grains is occupied by grains each having therein at least one twin plane and at least one dislocation line not parallel to the twin plane;

(2) The silver halide photographic material of (1), wherein the angle between the twin plane and the dislocation line is 30 degrees to 90 degrees;

(3) The silver halide photographic material of (1), wherein the angle between the twin plane and the dislocation line is 50 degrees to 90 degrees;

(4) The silver halide photographic material of (1), (2) or (3), wherein the number of the dislocation lines is from 1 to 10; and (5) The silver halide photographic material of (1), (2), (3) or (4), wherein the amount of bromide contained in the silver halide grains is 50 mol % or more based on all the halides.

DETAILED DESCRIPTION OF THE INVENTION

Figure 1A:
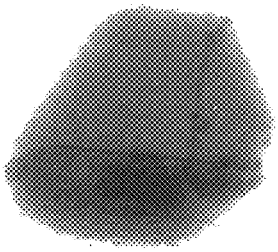
FIG. 1A and FIG. 1B show dislocation line microphotographs (40,000× magnification) observed under a transmission electron microscope, indicating crystal structures of typical silver halide grains (a) and (b) of emulsion A of the invention in Example 1, respectively.

First, the structure of the silver halide grain of the invention having therein at least one twin plane and at least one dislocation line not parallel to the twin plane will be described in detail.

The silver halide emulsion of the invention comprises at least a dispersing medium and silver halide grains, and 50% or more, preferably 70% or more, more preferably 90% or more of the total projected area of the silver halide grains is occupied by grains having the following characteristics. That is to say, each silver halide grain has therein preferably 3 or less, more preferably 2 or less twin planes and at least one dislocation line not parallel to the twin plane. The angle between the twin plane and the dislocation line is preferably from 30 degrees to 90 degrees, and more preferably from 50 degrees to 90 degrees. The size of the silver halide grains is preferably from 0.1 μm to 3 μm, more preferably from 0.1 μm to 2 μm, and still more preferably from 0.1 μm to 1 μm, by the average equivalent-sphere diameter.

The number of the dislocation lines in the silver halide grains of the invention is from 1 to 10, preferably from 1 to 6, and more preferably from 1 to 4.

In the invention, the dislocation line is a line extending from the inside at least 0.1 μm inside from a surface of the grain to the surface, and may reaches any site of the faces, sides and vertex portions of the silver halide grain. The surface of the grain as used herein means a region up to a depth of about 50 Å from the surface, and the inside of the grain means a region other than that.

In the invention, the dislocation line may intersects or come into contact with at least one twin plane in the inside of the grain, or may exist apart from the twin plane.

The dislocation lines of the silver halide grains can be observed by the direct method using a transmission electron microscope at low temperature described in, for example, J. F. Hamilton, *Phot. Sci. Eng.*, 11, 57 (1967) and T. Shiozawa, *J. Soc. Phot. Sci. Japan*, 35, 213 (1972). That is to say, the silver halide grains taken out of the emulsion under a safety lamp, taking care so as not to apply such a pressure that dislocation is developed in the grains, are placed on a mesh for observation with the electron microscope. The grains are observed by the transmission method in the state in which the sample is cooled so as to prevent damages (such as print-out) caused by an electron beam. At this time, the thicker silver halide grains results in more difficulty of transmitting the electron beam, so that the use of a high-voltage (200 keV or more to a thickness of 0.25 μm) electron microscope allows the grains to be observed more clearly. The number and site of the dislocation lines of each grain can be determined from a photograph of the grain obtained by such a method. At the same time, the presence or absence of the twin plane can be confirmed, so that the angle between the twin plane and the dislocation line can also be determined.

In the halogen composition of the silver halide grains of the invention, the rate of bromide is preferably 70 mol % or more, more preferably 80 mol % or more, and still more preferably 90 mol % or more.

The silver halide grains of the invention each having therein at least one twin plane and at least one dislocation line not parallel to the twin plane can be prepared according to processes shown below.

(1) Nucleation Process

An aqueous solution of an $Ag^+$ salt and an aqueous solution of an $X1^-$ (halogen ion) salt are added to a dispersing medium containing at least water and a protective colloid, by the double jet method with stirring, and allowed to react with each other to form host silver halide nuclei (AgX1). With respect to the halogen composition at this time, the $Br^-$ content is preferably 30 mol % or more, more preferably 50 mol % or more, and still more preferably 70 mol % or more. Further, the $I^-$ content is preferably 10 mol % or less, more preferably 5 mol % or less, and still more preferably 1 mol % or less. As the protective colloid, gelatin is used. Natural polymers other than gelatin and synthetic polymers are also similarly used. Gelatin and derivatives thereof that can be used include alkali-treated gelatin, oxidized gelatin in which methionine groups in gelatin molecules are oxidized with hydrogen peroxide and the like (methionine content: 40 μmol/g or less), amino group-modified gelatin (for example, phthalatedgelatin, trimellitated gelatin, succinated gelatin, maleated gelatin or esterified gelatin) and low molecular weight gelatin (molecular weight: 3,000 to 40,000). The natural polymers are described in JP-B-7-111550 and *Research Disclosure*, Vol. 176, No. 17643, IX, (December, 1978). The concentration of the protective colloid used in nucleating is preferably from 0.01% to 3% by weight, more preferably from 0.01% to 1% by weight, and still more preferably from 0.01% to 0.05% by weight. The pH of the aqueous solution of the dispersing medium is preferably from 4 to 8, when amino group-modified gelatin is used. However, when gelatin other than that is used, the pH is preferably from 2 to 9, and more preferably from 5 to 8. As excess halogen ions in nucleating, $Cl^-$ and $Br^-$ may exist either independently or together. The concentration thereof is preferably from $3\times10^{-5}$ mol/liter to 0.1 mol/liter, and more preferably from $3\times10^{-4}$ mol/liter to 0.01 mol/liter. The temperature in nucleating is preferably from 5° C. to 60° C., more preferably from 10° C. to 50° C., and still more preferably from 20° C. to 40° C.

(2) Ripening Process

In nucleating, normal crystal grains having no twin planes are concurrently formed. It is therefore necessary to allow such normal crystal grains to disappear before the beginning of a dislocation introduction process described later. For making this possible, it is well known that the Ostwald ripening is conducted subsequent to the nucleation. The pBr is adjusted just after the nucleation, and then, the temperature is elevated to conduct ripening until the ratio of the normal crystal grains is substantially decreased to 0. At this time, an aqueous solution of a protective colloid may be additionally added. In this case, the concentration of the protective colloid to the aqueous solution of the dispersing medium is preferably 10% by weight or less. The protective colloids used include the above-mentioned alkali-treated gelatin, oxidized gelatin, amino group-modified gelatin, natural polymers and synthetic polymers. The ripening temperature is preferably at least 10° C. higher than the temperature in nucleating, and usually from 50° C. to 90° C. The pBr is from 1.2 to 3.0. The pH of the aqueous solution of the dispersing medium is preferably from 4 to 8, when amino group-modified gelatin is used as the protective colloids. However, when gelatin other than that is used, the pH is preferably from 2 to 9, and more preferably from 5 to 8. For allowing the normal crystal grains to rapidly disappear, a solvent for a silver halide may be added. In this case, the solvents for silver halides include $NH_3$ and thioether compounds, and the concentration thereof is preferably $1\times10^{-1}$ mol/liter or less, and more preferably $1\times10^{-3}$ mol/liter or less, in a reaction vessel. When the solvent is used as an emulsion for direct reversal, the thioether compound used on the neutral or acidic side is more preferred than $NH_3$ used on the alkaline side as the solvent for a silver halides. After the termination of ripening, the solvent for a silver halide can be removed in the following manner, when the solvent is unnecessary in the subsequent growth process.

(1) In the case of the alkaline solvent for a silver halide such as $NH_3$, an acid having a large solubility product with $Ag^+$ such as $HNO_3$ is added for invalidation.

(2) In the case of the thioether solvent for a silver halide, an oxidizing agent such as $H_2O_2$ as described in JP-A-60-136736 is added for invalidation.

(3) Dislocation Introduction Process

Subsequent to the ripening process, an aqueous solution of an $Ag^+$ salt and an aqueous solution of an $X2^-$ salt are added into a reaction vessel by the double jet method to deposit an AgX2 layer on each of the twin plane-containing AgX1 host nuclei. As to the halogen composition of X2, the $I^-$ content is preferably 15 mol % or more, more preferably 20 mol % or more, and still more preferably 30 mol % or more. The $Br^-$ content is preferably 50 mol % or more. As a supply source for $I^-$, fine AgI grains or an iodide ion-releasing agent may be used. The molar amount of $Ag^+$ added for forming the AgX2 layer is preferably 0.1 to 3 times the molar amount of $Ag^+$ that has formed the AgX1 host nucleus. Then, an aqueous solution of an $Ag^+$ salt and an aqueous solution of an $X3^-$ salt are added by the double jet method to deposit an AgX3 layer on each of the twin plane-containing AgX1 host nuclei on which the AgX2 layer has been deposited. That is to say, the discontinuous silver halide layer different from the AgX2 layer in halogen composition is further deposited on the AgX1 host nucleus on which the AgX2 layer has been deposited, thereby substantially generating dislocation on a surface of junction. The probability of the dislocation generation increases with an increase in the difference in halogen composition between AgX2 and AgX3. It is preferred that the introduction of the dislocation is achieved by the difference in $I^-$ content. For the halogen. composition of X3, the $Br^-$ content is preferably 80 mol % or more,more preferably 90 mol % or more, and still more preferably 95 mol % or more. The $I^-$ content is preferably 10 mol % or less, more preferably 5 mol % or less, and still more preferably 1 mol % or less. The molar amount of $Ag^+$ added for forming the AgX3 layer is preferably 0.5 to 10 times the total molar amount of $Ag^+$ that has formed the AgX1 host nucleus and the AgX2 layer deposited thereon. When AgX3 is deposited, the addition speed of the aqueous solution of the $Ag^+$ salt is preferably from 2 g/minute to 30 g/minute, and more preferably from 2 g/minute to 20 g/minute, per an amount of $AgNO_3$. Further, after AgX2 has been deposited on the AgX1 host nucleus, the AgX3 layer starts to be deposited preferably at an interval of 20 seconds to 3 minutes, more preferably at an interval of 20 seconds to 1 minute. The dislocation can also be generated by addition of a different kind of aqueous solution of $X2^-$ salt alone (when $X2^-$ has formed AgX2, it is preferably lower in solubility than the AgX1 host nucleus) or impurities (such as yellow prussiate) to the AgX1 host nucleus, in stead of the deposition of AgX2. The dislocation is considered to be screw dislocation enhancing the growth of silver halide grains as described in detail in *Journal of Crystal Growth*, 23, 207 (1974), JP-A-6-59360, JP-A-7-234470, JP-A-8-122954, JP-A-8-339044, JP-A-9-189977 and Japanese Patent Application No. 11-92883, but it is not necessarily clear. The concentration of the protective colloid to the aqueous solution of the dispersing medium used in dislocation introduction is from 1% to 10% by weight. The temperature used in dislocation introduction may be the temperature used in ripening, and usually from 50° C. to 90° C. The pBr is preferably from 1.2 to 3.0, and more preferably from 1.2 to 2.5. The pH of the aqueous solution of the dispersing medium is preferably from 4 to 8, when amino group-modified gelatin is used as the protective colloid.

However, when gelatin other than that is used, the pH is preferably from 2 to 9, and more preferably from 5 to 8.

(4) Growth Process

The silver halide grains of the invention thus formed through the nucleation process, the ripening process and the dislocation introduction process can be allowed to grow to a desired size as needed. In this case, there are three methods: (1) an ion addition method of adding an aqueous solution of an $Ag^+$ salt and an aqueous solution of an $X^-$ salt, thereby allowing grains to grow, (2) a fine-grain addition method of adding fine AgX grains previously prepared, thereby allowing grains to grow, and (3) a method using both in combination.

(1) Ion Addition Method

In the ion addition method, the aqueous solution of the $Ag^+$ salt and the aqueous solution of the $X^-$ salt are added by the C. D. J. (controlled double jet) method in which concurrent mixing addition is carried out at an addition speed at which new nuclei are not substantially developed, while keeping the pBr in a reaction vessel constant, thereby allowing the silver halide grains of the invention to grow. The term "not substantially developed" as used herein means that the projected area ratio of the new nuclei is preferably 10% or less, more preferably 1% or less, and still more preferably 0.1% or less. For the halogen composition of the aqueous solution of the $X^-$ salt, the $Br^-$ content is preferably 80 mol % or more, more preferably 90 mol % or more, and still more preferably 95 mol % or more. The $I^-$ content is preferably 10 mol % or less, more preferably 5 mol % or less, and still more preferably 1 mol % or less. The growth temperature in the ion addition method may be the temperature used in dislocation introduction, and usually from 50° C. to 90° C. The pBr is preferably from 1.2 to 5.0. Further, a solvent for a silver halide may be allowed to coexist.

(2) Fine-Grain Addition Method

In the fine-grain addition method, an emulsion of fine silver halide grains having a projected grain diameter of 0.1 μm or less, preferably 0.05 μm or less and more preferably 0.02 μm or less is added either continuously or intermittently, and the silver halide grains of the invention are allowed to grow by the Ostwald ripening. The fine-grain emulsion is continuously prepared by feeding the aqueous solution of the $Ag^+$ salt and the aqueous solution of the $X^-$ salt containing a polymer acting as a protective colloid to a mixer provided in the vicinity of a reaction vessel, which is described in JP-B-7-82208, JP-B-7-23218, JP-A-10-43570 and U.S. Pat. No. 4,879,208, and immediately continuously added to the reaction vessel. The emulsion previously prepared in another vessel in a batch process may also be added either continuously or intermittently. It is preferred that the fine grains are substantially free from twin grains. The term "substantially free" means that ratio of the twin grains is 5% or less, preferably 1% or less, and more preferably 0.1% or less. For the halogen composition of the fine grains, the $Br^-$ content is preferably 80 mol % or more, more preferably 90 mol % or more, and still more preferably 95 mol % or more. The $I^-$ content is preferably 10 mol % or less, more preferably 5 mol % or less, and still more preferably 1 mol % or less.

As to the preparation conditions of the fine grains, the temperature is preferably 50° C. or less, more preferably from 5° C. to 40° C., and still more preferably from 10° C. to 30° C. The protective colloid used is preferably a colloid in which low molecular weight gelatin having a molecular weight of preferably from2,000 to 60,000, and more preferably from 5,000 to 40,000, occupies preferably 30% by weight or more, more preferably 50% by weight or more, and still more preferably 80% by weight or more. The concentration of the protective colloid in the aqueous solution of the $X^-$ salt is preferably 0.2% by weight or more, and more preferably from 1% to 10% by weight.

The growth conditions of the silver halide grains of the invention according to the fine-grain addition method may be the same as the above-mentioned conditions (the temperature, the pH and the concentration of the solvent for the silver halide) in ripening. The reason for this is that both are processes in which fine normal crystal grains are allowed to disappear by the Ostwald ripening, and mechanically identical to each other. Different from the conditions in ripening, only the pBr is preferably from 1.2 to 5.0. As to the general fine-grain addition method, reference can be made to the descriptions of JP-A-1-183417, JP-A-4-34544 and JP-A-5-281640.

The silver halide grain emulsion prepared as described above is subsequently subjected to a process for removing excess salts produced by addition of the $Ag^+$ salt and the $X^-$ salt. In this case, gelatin may be added before washing with water, for accelerating the precipitation of grains. The water washing methods that can be used herein include methods that have hitherto been known, that is to say, (1) noodle water washing method, (2) a method of adding a precipitating agent to precipitate an emulsion, (3) a method using modified gelatin such as phthalated gelatin and (4) an ultrafiltration method (for details thereof, refer to G. F. Duffin, Photographic Emulsion chemistry, Focal Press, London (1966) and literatures described later).

The silver halide emulsions of the invention are subjected to chemical sensitization, and then used. With respect to chemical sensitization, chalcogen sensitization (sulfur sensitization, selenium sensitization and tellurium sensitization), noble metal sensitization (for example, gold sensitization) and reduction sensitization can be conducted alone or in combination. In sulfur sensitization, unstable sulfur compounds are used as sensitizers. The unstable sulfur compounds are described in P. Glafkides, *Chemie et Physique Photographique*, 5th ed., Paul Montel (1987), *Research Disclosure*, Vol. 307, No. 307105, *The Theory of the Photographic Process*, 4th ed., edited by T. H. James, Macmillan (1977) and H. Frieser, *Die Grundlagender Photographischen Prozess mit Silverhalogeniden*, Akademishe Verlags-gesellschaft (1968). Examples of the sulfur sensitizers include thiosulfates (for example, sodium thiosulfate and p-toluene thiosulfonate), thioureas (for example, diphenylthiourea, triethylthiourea, N-ethyl-N'-(4-methyl-2-thiazolyl) thiourea and carboxymethyltrimethylthiourea), thioamides (for examples, thioacetamide and N-phenylthioacetamide), rhodanine derivatives (for example, rhodanine, N-ethylrhodanine, 5-benzylidenerhodanine, 5-benzylidene-N-ethylrhodanine and diethylrhodanine), phosphine sulfides (for example, trimethylphosphine sulfide), thiohydantoins, 4-oxooxazolidine-2-thiones, dipolysulfides (for example, dimorpholine disulfide, cystine and hexathiokane-thione), mercapto compounds (for example, systein), polythionates and elementary sulfur. Active gelatin can also be used as the sulfur sensitizer.

In selenium sensitization, unstable selenium compounds are used as sensitizers. The unstable selenium compounds are described in JP-B-43-13489, JP-B-44-15748, JP-A-4-25832, JP-A-4-109240, JP-A-4-271341 and JP-A-5-40324. Examples of the selenium sensitizers include colloidal metallic selenium, selenoureas (for example, N,N-dimethylselenourea, trifluoromethylcarbonyltrimethylselenourea and acetyltrimethylselenourea), selenoamides (for example, selenoacetamide and N,N-diethylphenylselenoamide), phosphine selenides (for example, triphenylphosphine selenide, pentafluorophenyltriphenylphosphine selenide), selenophosphates (for example, tri-p-tolyl selenophosphate and tri-n-butyl selenophosphate), selenoketones (for example, selenobenzophenone), isoselenocyanates, selenocarboxylic acids, selenoesters and diacyl selenides. Relatively stable selenium compounds such as selenious acid, potassium selenocyanate, selenazoles and selenides (described in JP-B-46-4553 and JP-B-52-34492) can also be utilized as the selenium sensitizers.

In tellurium sensitaizaiton, unstable tellurium compounds are used as sensitizers. The unstable tellurium compounds are described in Canadian Patent 800,958, British Patents 1,295,462 andl,396,696, JP-A-4-204640, JP-A-4-271341, JP-A-4-333043 and JP-A-5-303157. Examples of the tellurium sensitizers include tellureureas (for example, tetramethyltellurourea, N,N'-dimethylethylenetellurourea and N,N'-diphenylethylenetellurourea), phosphine tellurides (for example, butyldiisopropylphosphine telluride, tributylphosphine telluride, tributoxyphosphine telluride and ethoxydiphenylphosphine telluride), diacyl (di)tellurides (for example, bis(diphenylcarbamoyl) ditelluride, bis (N-phenyl-N-methylcarbamoyl) ditelluride, bisN-phenyl-N-methylcarbamoyl) telluride and bis (ethoxycarbonyl) telluride), isotellurocyanates (for example, allyl isotellurocyanate), telluroketones (for example, telluroacetone and telluroacetophenone), telluroamides (for example, telluroacetamide and N,N-dimethyltellurobenzamide), tellurohydrazides (for example, N,N',N'-trimethyltellurobenzhydrazide), telluroesters (for example, t-butyl-t-hexyl telluroester, colloidal tellurium, (di)tellurides and other tellurium compounds (for example, potassium telluride and sodium telluropentathionate).

In noble metal sensitization, salts of noble metals such as gold, platinum, palladium and iridium are used as sanitizers. The noble metal salts are described in P. Glafkides, *Chemie et Physique Photographique*, 5th ed., Paul Montel (1987) and *Research Disclosure*, Vol. 307, No.307105. Gold sensitization is particularly preferred. Examples of the gold sensitizers include chloroauric acid, potassium chloroaurate, potassium aurithiocyanate, gold sulfide and gold selenide. Further, gold compounds described in U.S. Pat. Nos. 2,642,361, 5,049,484 and 5,049,485 can also be used.

In reduction sensitization, reducing compounds are used as sensitizers. The reducing compounds are described in P. Glafkides, *Chemie et Physique Photographique*, 5th ed., Paul Montel (1987) and *Research Disclosure*, Vol. 307, No. 307105. Examples of the reducing sensitizers include aminoiminomethanesulfinic acid (thioureadioxide), borane compounds (for example, dimethylamine borane), hydrazine compounds (for example, hydrazine and p-tolylhydrazine), polyamine compounds (for example, diethylenetriamine and triethylenetetramine), stannous chloride, silane compounds, reductions (for example, ascorbic acid), sulfites, aldehyde compounds and hydrogen. Further, reduction sensitization can also be conducted in an atmosphere of high pH or excess silver ions (so-called silver ripening).

Chemical sensitization may be conducted as a combination of two or more kinds of sensitization processes. The combination of chalcogen sensitization and gold sensitization is particularly preferred. Further, reduction sensitization is preferably performed in forming the silver halide grains. The amount of the sensitizers used is generally determined depending on the kind of silver halide grain and the conditions of chemical sensitization. The amount of the chalcogen sensitizers used is generally from $10^{-7}$ mol to $10^{-2}$ mol, and preferably from $10^{-7}$ mol to $5\times10^{-3}$ mol, per mol of silver halide. The amount of the noble metal sensitizers used is preferably from $10^{-7}$ mol to $10^{-2}$ mol per mol of silver halide. There is no particular limitation on the conditions of chemical sensitization. The pAg is from 6 to 11, and preferably from 7 to 10. The pH is preferably from 4 to 10. The temperature is preferably from 40° C. to 95° C., and more preferably from 45° C. to 85° C.

Using the silver halide grains prepared in the invention as host grains, epitaxial grains may be formed. For this, reference can be made to the descriptions of J. E. Maskasky, *J. Imag. Sci.*, 32, 166 (1988), JP-A-64-26837, JP-A-64-26838, JP-A-64-26840, JP-A-1-179140, and U.S. Pat. Nos. 4,865,962 and 4,968,595. Further, the silver halide grains may be used as cores to form internal latent image type grains, or laminated with silver halide layers different from the grains in halogen composition to form so-called core/shell type grains. For these, reference can be made to the descriptions of JP-A-59-133542, JP-A-63-151618, and U.S. Pat. Nos. 3,206,313, 3,317,322, 3,367,778, 3,761,276 and 4,269,927.

There is no particular limitation on additives that can be added to the silver halide emulsions of the invention between grain formation and coating, and all known photographic additives can be used as needed. For chemical sensitizers (sulfur, selenium, tellurium, gold and the group VIII noble metal compounds, phosphor compounds, rhodanide compounds and reducing sensitizers, alone or a combination of two or more of them), sensitizing dyes (blue, green, red, infrared, panchromatic and orthochromatic), supersensitizers, antifoggants, doping agents to silver halide grains (for example, the group VIII noble metal compounds, metal complex compounds having inorganic and organic compounds as ligands, chalcogen compounds and thiocyanogen compounds), solvents for silver halides, crystal habit regulators, stabilizers, dyes, color couplers, DIR couplers, binders, hardeners, coating aids, thickening agents, emulsion precipitants, plasticizers, pressure-induced desensitization inhibitors, dimensional stability improvers, antistatic agents, adhesion inhibitors, photographic characteristic improvers (for example, development accelerators and hard degradation enhancers), couplers releasing photographically advantageous fragments (development inhibitors or accelerators, bleach accelerators, developing agents, solvents for silver halides, toners, hardeners, antifoggants, competitive couplers, chemical or spectral sensitizers and desensitizers), image dye stabilizers, self-inhibition developing agents and methods for using the same, hypersensitization in spectral sensitization, the halogen receptor effect and electron receptor effect of spectral sensitizing dyes, the functions of antifoggants, stabilizers, development accelerators or inhibitors, apparatus used for the production of the emulsions of the invention, reaction apparatus, stirring apparatus, coating, drying methods, exposure methods (light sources, exposure atmospheres and exposing methods), photographic supports, fine porous supports, undercoat layers, surface protective layers, matte agents, intermediate layers, antihalation layers, the layer constitution of AgX emulsions, photographic processing agents and photographic processing methods, reference can be made to the descriptions of *Research Disclosure*, Vol.176, item 17643 (December, 1978), ibid., Vol. 184, item 18431 (August, 1979), ibid., Vol. 134, item 13452 (June, 1975), ibid., Vol. 307, item 30701 (November, 1989), Product Licensing Index, Vol. 92, 107–110 (December, 1971), JP-A-58-113926 toll3928, JP-A-61-3134, JP-A-62-6251, Nikkakyo Geppo, pages 18 to 27 (December, 1984), JP-A-62-219982, *The Theory of the Photographic Process*, 4th ed., edited by T. H. James, Macmillan (1977) and V. L. Zelikman et al., *Making and Coating Photographic Emulsion*, The Focal Press (1964).

The silver halide emulsion of the invention can be applied onto a support in one or more layers, together with one or more different emulsions as needed. Further, the emulsion can be applied onto not only one side of the support, but also both sides thereof. Furthermore, the emulsion can be applied together with an emulsion different therefrom in spectral sensitivity, in multiple layers.

There is no particular limitation on the layer constitution of the silver halide photographic materials. However, in the case of color photographic materials, blue, green and red lights are separately recorded, so that the materials have multiple layer structures. Each silver halide emulsion layer may be comprised of two layers, a high-sensitivity layer and a low-sensitivity layer. Practical examples of the layer structures include (1) to (6) shown below.

(1) BH/BL/GH/GL/RH/RL/S (2) BH/BM/BL/GH/GM/GL/RH/RM/RL/S (3) BH/BL/GH/RH/GL/RL/S (4) BH/GH/RH/BL/GL/RL/S (5) BH/BL/CL/GH/GL/RH/RL/S (6) BH/BL/GH/GL/CL/RH/RL/S

B is a blue-sensitive layer, G is a green-sensitive layer, R is a red-sensitive layer, H is a high-sensitivity layer, M is a medium-sensitivity layer, L is a low-sensitivity layer, S is a support, and CL is a layer for imparting an interlayer effect. Light-insensitive layers such as a protective layer, a filter layer, an intermediate layer, an antihalation layer and an underlayer are not shown. A high-sensitivity layer and a low-sensitivity layer each having the same spectral sensitivity may be arranged in reverse. (3) is described in U.S. Pat. No. 4,184,876, and (4) is described in *Research Disclosure*, Vol. 225, No. 22534, JP-A-59-177551 and JP-A-59-177552. Further, (5) and (6) are described in JP-A-61-34541. The preferred layer structures are (1), (2) and (4).

The silver halide emulsions of the invention can be used for black-and-white silver halide photographic materials (for example, X-ray sensitive materials, sensitive materials for printing, printing paper, negative films, microfilms and direct positive sensitive materials), ultrafine-grain drying plate sensitive materials (for LSI photomasks, for shadow masks and for liquid crystal masks), and color photographic materials (for example, negative films, printing paper, reversal films and direct positive color sensitive materials) Further, they can also be used for sensitive materials for diffusion transfer (for example, color diffusion transfer elements and silver salt diffusion transfer elements), heat developable light-sensitive materials (black-and-white and color), high-density digital recording sensitive materials and sensitive materials for holography. As to the amount of silver coated, a preferred value can be selected from 0.01 $g/m^2$ or more.

The invention will be illustrated in more detail with reference to examples below, but these are not to be construed as limiting the scope of the invention.

EXAMPLE 1

Preparation of Emulsion A of the Invention

In a reaction vessel was placed 1205 ml of an aqueous solution of gelatin (containing 0.6 g of deionized alkali-treated low molecular weight ossein gelatin (molecular weight: 20,000) having amethionine content of about 40

μmol/g and 0.46 g of KBr). Then, 20 ml of solution Ag-1 (containing 5 g of $AgNO_3$ in 100 ml) and 20 ml of solution X-1 (containing 3.5 g of KBr in 100 ml) were added thereto at 30 ml/minute by the double jet method with stirring while keeping the temperature at 40° C. After stirring for 1 minute, 25 ml of a 10% aqueous solution of KBr was added, and the temperature was elevated to 75° C. in 15 minutes. Immediately after temperature elevation, 350 ml of an aqueous solution of a dispersing medium containing 35 g of deionized alkali-treated ossein gelatin (methionine content: about 40 μmol/g) was newly added. After stirring for 2 minutes, 3 ml of an aqueous solution of 3,6-dithia-1,8-octanediol (1.0% by weight) was added. After further stirring for 5 minutes, 17 ml of solution Ag-1 was added at an initial flow rate of 3 ml/minute while accelerating the flow rate at a rate of 0.18 ml/minute. Meanwhile, solution X-2 (containing 2.7 g of KBr and 2.0 g of KI in 100 ml) was concurrently added by the C. D. J. (controlled double jet) method so as to keep the pBr at 2.5. One minute after the termination of the addition, 23 ml of solution Ag-1 and 23 ml of solution X-1 were added at 72 ml/minute by the double jet method. Subsequently, solution Ag-2 (containing 16 g of $AgNO_3$ in 100 ml) and solution X-3 (containing 11.2 g of KBr and 11.5 g of deionized alkali-treated low molecular weight gelatin (molecular weight: 20,000) in 100 ml) were concurrently added in a 0.5 ml of the solution well stirred described in JP-A-10-43570, at 10.5ml/minute and 10.7ml/minute, respectively, and mixed. The fine grains of AgBr formed (average projected grain diameter: 0.025 μm) were continuously added to a reaction vessel. During the addition of the fine-grain emulsion, the temperature in the reaction vessel and the pBr were kept constant at 75° C. and 2.5, respectively. Solution Ag-2 was added in an amount of 630 ml. Two minute after the termination of the addition of the fine grains, the temperature was lowered to 35° C., and soluble salts were removed by the conventional precipitation method. Then, the temperature was elevated again to 50° C., followed by additional addition of gelatin. KBr and NaOH were added and dissolved to adjust the pH and the pAg to 5.5 and 8.6, respectively. The average equivalent-sphere diameter of the silver halide grains thus prepared was 0.65 μm. The average AgBr content of the grains was 97.7 mol % or more.

Observation of Dislocation Lines under Transmission Electron Microscope

Figure 1B:
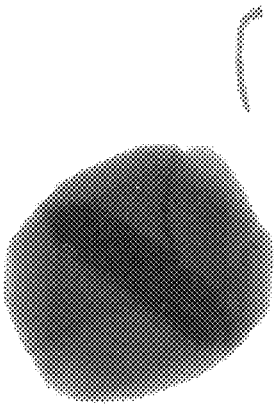

For the silver halide grains of emulsion A of the invention described above, dislocation lines were directly observed under a transmission electron microscope. The observation was made at an acceleration voltage of 400 keV at a temperature of −170° C., using a JEM-4000EX electron microscope manufactured by JEOL Ltd. As a result, at least 90% of the silver halide grains in the total projected area and at least 90% of the grains in number each had at least one twin plane, and 1 to 4 dislocation lines not parallel to the twin plane. Two typical transmission electron photomicrographs of the silver halide grains are shown in FIG. 1A and FIG. 1B. In the grain of (a), one dislocation line not parallel to a twin plane is observed only on one side of the twin plane (see FIG. 1A). In the grain of (b), one dislocation line not parallel to a twin plane is observed on each of both sides of the twin plane (see FIG. 1B).

Preparation of Emulsion B for Comparison

An octahedral pure AgBr grain emulsion having an average equivalent-sphere diameter of 0.65 μm was prepared. The pH of this emulsion was 5.5, and the pAg was 8.6.

To emulsion A were added $7.2\times10^{-5}$ mol per mol of silver of sodium thiosulfate and $0.8\times10^{-5}$ mol per mol of silver of chloroauric acid, followed by optimum chemical sensitization at 60° C. Similarly, $1.0\times10^{-5}$ mol per mol of silver of sodium thiosulfate and $0.9\times10^{-5}$ mol per mol of silver of chloroauric acid were added to emulsion B, followed by optimum chemical sensitization at 60° C.

Each of these emulsion A and emulsion B subjected to the chemical sensitization, to which gelatin and sodium dodecylbenzenesulfonate were added, was applied onto a triacetyl cellulose film support having an undercoat layer, together with a protective layer containing gelatin, polymethyl methacrylate particles and 2,4-dichloro-6-hydroxy-s-triazine sodium salt by the extrusion process at a silver amount of 2 g/m$^2$. Thus, coated samples 1 and 2 were obtained. These emulsions to which sensitizing dye (1) was added in an amount of $2.6\times10^{-4}$ mol per mol of silver were each spectrally sensitized and applied in the same manner as with coated samples 1 and 2, thereby obtaining coated samples 3 and 4. Similarly, the emulsions to which sensitizing dye (1) was added in an amount of $6.5\times10^{-4}$ mol per mol of silver were each spectrally sensitized and applied, thereby obtaining coated samples 5 and 6.

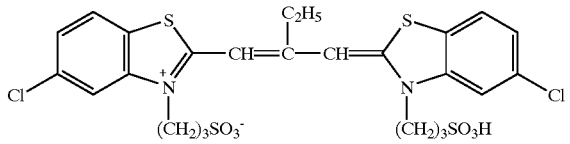

Sensitizing Dye (1)

Using a blue filter (BPN-42, manufactured by Fuji Photo Film Co., Ltd.), exposure for sensitometry was given to coated samples 1 to 6 through an optical wedge for 1 second. Then, the samples were developed at 20° C. for 10 minutes with a developing solution obtained according to the following formulation, and then, stopped, fixed, washed with water and dried by conventional methods, followed by measurement of the optical density. The fog was determined as the minimum optical density of the samples, and the sensitivity was evaluated by the logarithm of the reciprocal of an exposure amount required to give a density of fog +0.1. The values of samples 1 and 3 to 6 were represented by relative values, taking the value of sample 2 as 100. In addition, exposure for sensitometry was given to coated samples 3 to 6 through an optical wedge for 1 second, using a blue cut filter (SC-50, manufactured by Fuji Photo Film Co., Ltd.). Then, the samples were processed in the same manner as described above, and the optical density was measured to evaluate the sensitivity in the same manner as described above. The values of samples 3, 4 and 5 were represented by relative values, taking the value of sample 6 as 100. Results thereof are shown in Table 1.

Developing Solution

| | |
|---|---|
| Metol | 2.5 g |
| L-Ascorbic Acid | 10.0 g |
| NABOX | 35.0 g |
| KBr | 1.0 g |

Water was added to bring the volume to 1 liter, and the pH was adjusted to 9.6.

TABLE 1

| | Coated Sample No. | Relative Sensitivity BPN-42 Filter | Relative Sensitivity SC-50 Filter |
|---|---|---|---|
| Invention | 1 (Gold sulfur sensitization) | 103 | — |
| | 3 (Gold sulfur sensitization + addition of a small amount of dye (1)) | 105 | 264 |
| | 5 (Gold sulfur sensitization + addition of a large amount of dye (1)) | 92 | 257 |
| Comparison | 2 (Gold sulfur sensitization) | 100 | — |
| | 4 (Gold sulfur sensitization + addition of a small amount of dye (1)) | 89 | 250 |
| | 6 (Gold sulfur sensitization + addition of a large amount of dye (1)) | 15 | 100 |

As apparent from Table 1, the coated samples in which the emulsions of the invention were used had high sensitivity in inherent absorption of silver halide grains thereof, and were also significantly improved in inherent desensitization caused by sensitizing dyes particularly in the region of increased amounts of the dyes added, compared with the samples in which the emulsions for comparison were used. In the region of increased amounts of the dyes added, the spectral sensitivity was also extremely high. Japanese Patent Application No. 11-92883 discloses that screw dislocation enhancing the growth of silver halide grains improves the photographic characteristics, like the silver halide emulsions of the invention, even when the number of dislocation lines is as small as 6 or less. However, in the region of increased amounts of the dyes added, the silver halide emulsions of the invention are far higher in the degree of improving the photographic characteristics than those described in Japanese Patent Application No. 11-92883. Judging from the fact that the average AgBr content of the grains is 97.7 mol % or more, and the pBr in growing is 2.5, most outer surfaces of the silver halide grains are considered to be {111} faces. Accordingly, the reason for this may be that when the outer surfaces are {111} faces rather than {100} faces (the grains described in Japanese Patent Application No. 11-92883 are rectangular parallelepiped grains outer surfaces of which are {100} faces), the dislocation lines improve the photographic characteristics more effectively. It is also possibly the synergistic effect caused by the coexistence of the twin planes and screw dislocation in the silver halide grains.

The invention can provide the photographic materials using the silver halide photographic emulsions having high sensitivity and high bromide content in halogen composition, having high sensitivity in inherent absorption of the silver halide grains thereof, moreover, having small inherent desensitization also in addition of the sensitizing dyes, particularly in the region of increased amounts of the dyes added, and also improved in spectral sensitivity, compared with octahedral non-dislocated normal crystal AgBr emulsions.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one layer of a light-sensitive silver halide emulsion, in which said emulsion comprises at least a dispersing medium and silver halide grains, and 50% or more of the total projected area of said silver halide grains is occupied by grains each having therein at least one twin plane and at least one dislocation line not parallel to the twin plane.

2. The silver halide photographic material according to claim 1, wherein the angle between the twin plane and the dislocation line is 30 degrees to 90 degrees.

3. The silver halide photographic material according to claim 1, wherein the angle between the twin plane and the dislocation line is 50 degrees to 90 degrees.

4. The silver halide photographic material according to claim 1, wherein the number of the dislocation lines is from 1 to 10.

5. The silver halide photographic material according to claim 1, wherein the amount of bromide contained in the silver halide grains is 50 mol % or more based on all the halides.

6. The silver halide photographic material according to claim 1, wherein said silver halide grains comprise grains with {111} faces on the outer surfaces thereof.

7. The silver halide photographic material according to claim 1, said silver halide grains comprise grains with a bromide content of 90% or more.

* * * * *